United States Patent [19]

Orndorff et al.

[11] Patent Number: 4,726,449

[45] Date of Patent: Feb. 23, 1988

[54] ELEVATOR CAB AND DOOR STRIKE POST CONSTRUCTION THEREFOR

[75] Inventors: Karl B. Orndorff, Bonneauville Boro; Paul L. Baldwin, Franklin Township, both of Pa.; Larry M. Markle, Harney, Md.

[73] Assignee: Westinghouse Electric Corp., Pittsburgh, Pa.

[21] Appl. No.: 945,045

[22] Filed: Dec. 22, 1986

[51] Int. Cl.[4] ..... B66B 13/30

[52] U.S. Cl. ..... 187/1 R; 187/56; 49/404; 52/205; 362/76

[58] Field of Search ..... 187/1 R, 56, 51, 52 R; 49/404; 52/204, 205; 362/76, 367, 431; 116/64, 226

[56] References Cited

U.S. PATENT DOCUMENTS 4,029,176 6/1977 Mills ..... 187/52 R
4,357,993 11/1982 Halpern et al. ..... 187/1 R

FOREIGN PATENT DOCUMENTS 671223 9/1963 Canada ..... 187/51
677915 12/1964 Italy ..... 187/52

*Primary Examiner*—Joseph J. Rolla
*Assistant Examiner*—Nils E. Pedersen
*Attorney, Agent, or Firm*—D. R. Lackey

[57] ABSTRACT

An elevator cab having a platform, upstanding wall panels on the platform which define an enclosure having an opening, a door mounted to open and close the opening, and a strike post assembly for the door. The strike post assembly, which includes an inner stationary post and an outer post coupled together to define a vertically extending enclosure, includes hall lanterns mounted in the enclosure, and resilient door stops or bumpers mounted on the outer post. The outer post holds the lenses for the hall lanterns without apparent fastener hardware, and it further functions as a removable cover for the hall lanterns, while concealing a single vertical column of fastener hardware which fixes the outer post to the inner post behind the resilient door bumpers.

6 Claims, 4 Drawing Figures

ELEVATOR CAB AND DOOR STRIKE POST CONSTRUCTION THEREFOR

BACKGROUND OF THE INVENTION

1. Field of the Invention

The invention relates in general to elevator cabs, and more specifically to elevator cabs having side opening doors which have hall lanterns mounted in the door strike post.

2. Description of the Prior Art

It is common in the prior art to mount the up and down direction hall lanterns in the door strike post of an elevator cab having side opening doors. The lamps of the hall lanterns are commonly mounted in an electrical junction box disposed behind a small removable face plate removably fixed to the strike post. The removable face plate holds the hall lantern lenses in a functional position in front of the lamps, and its removal permits the lamps to be replaced when burned out.

Visible fastener hardware invites vandalism, and it is an object of the present invention to improve upon the strike post assembly of an elevator cab when the hall lanterns are to be mounted therein.

SUMMARY OF THE INVENTION

Briefly, the present invention is a new and improved elevator cab in which hall lanterns are mounted in the strike post without visible fasteners, while constructing the strike post in a manner which eliminates the need for a separate electrical junction box for the hall lamps.

More specifically, the strike post includes inner and outer elongated metallic posts, with the inner post being fixed to a cab sidewall. The inner and outer posts are each channel shaped in cross section, and they are mounted with their channel openings facing one another to form a mechanically strong, rigid box assembly or vertically extending enclosure which also functions as one elongated electrical junction box. Thus, the need for a separate electrical junction box for the lamps associated with the hall lanterns is eliminated.

The entire outer post functions as a removable cover for the junction box, and it is fixed to the inner post with concealed hardware which is easily accessed by authorized personnel having knowledge of the fastener location. The studs which fix the inner post to a cab sidewall are extended into the vertically extending enclosure formed by the inner and outer posts, and a channel leg of the outer post includes openings which enable the outer post to be advanced into the proper cooperative relationship with the inner post while the studs slide into stud receiving openings. Resilient bushings protect the interface from metal-to-metal contact and thus prevent audible vibrations, and they also absorb shock forces which may be applied to the outer strike post during operation of the elevator cab.

The remaining channel leg of the outer post is itself formed into an auxiliary channel-like configuration adjacent to its end, in which a first leg of the auxiliary channel extends perpendicularly outward from the main channel leg. The first leg of the auxiliary channel also includes a plurality of vertically spaced openings, such as three, for receiving resilient door stops or bumpers against which the cab door stops when it reaches its closed position. The second leg of the auxiliary channel includes openings aligned with the door stop openings of the first leg, and fasteners are disposed through these openings to removable secure the outer strike post to the inner post. Thus, when the resilient door stops are frictionally engaged with their associated openings, they conceal the fastener hardware.

The hall lantern lenses are disposed through openings in the jamb surface of the outer strike post, from the inner side thereof, and are thus also held in operative position without hardware accessible from the external side of the strike post.

Lamp replacement is quickly and easily accomplished by removing the resilient door stops to gain access to the fastener hardware. Once the fastener hardware is released, the whole outer strike post is moved laterally to disengage the studs from the stud receiving openings, and the hall lantern lamps are accesssible on the back side of the outer strike post. A damaged hall lantern lens may be changed by the same procedure.

BRIEF DESCRIPTION OF THE DRAWINGS

The invention may be better understood, and further advantages and uses thereof more readily apparent, when considered in view of the following detailed description of exemplary embodiments in which.

DESCRIPTION OF PREFERRED EMBODIMENTS

Figure 1:
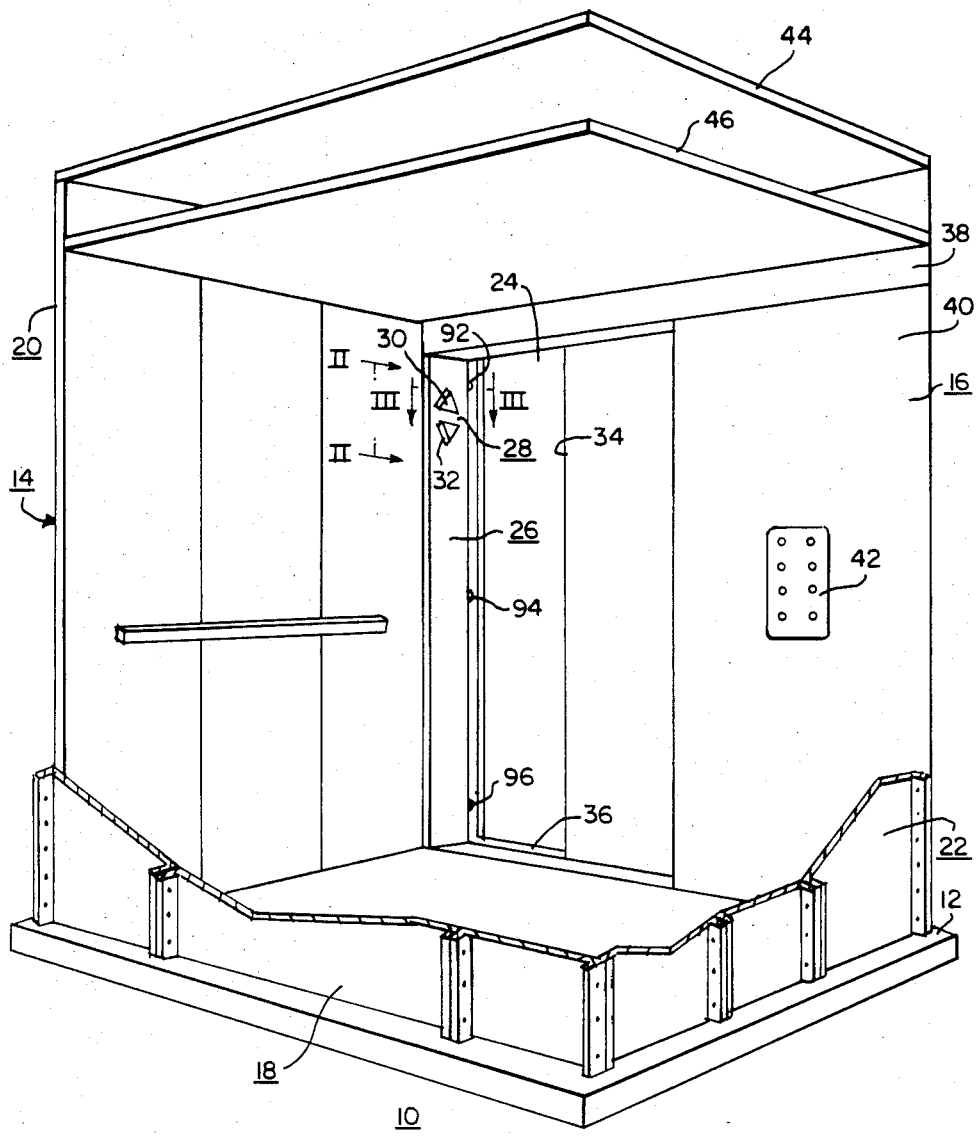
FIG. 1 is a perspective view of an elevator cab, shown partly cut away, which may be constructed according to the teachings of the invention.

Referring now to the drawings, and to FIG. 1 in particular, there is shown an elevator cab 10 which may be constructed according to the teachings of the invention. Cab 10 includes a platform 12 upon which upstanding wall portions are assembled to define an enclosure 14, with the upstanding wall portions including front, rear, and first and second sidewall portions 16, 18, 20 and 22, respectively. The front wall portion 16 defines a passenger entrance or opening 24 of the side opening type, as opposed to the center opening type, and thus a door strike post or jamb 26 is provided at one side of the opening 24. The door strike jamb 26 includes hall lantern means 28, which includes up and down lenses 30 and 32, respectively. A door 34 having one or more panels, as desired, is mounted for guided movement via a door operator (not shown) and a door sill 36, to open and close the entrance opening 24. The front wall portion 16 may also include a transom 38 disposed above the door 34, and a return 40 in which a car station 42 is mounted. A canopy 44 is attached to upper edges of the enclosure 14, to which appropriate lighting fixtures may be attached, and a drop ceiling 46 may be suspended from the canopy 44 to conceal the source of the light, as well as to diffuse and uniformly distribute the light.

Figure 2:
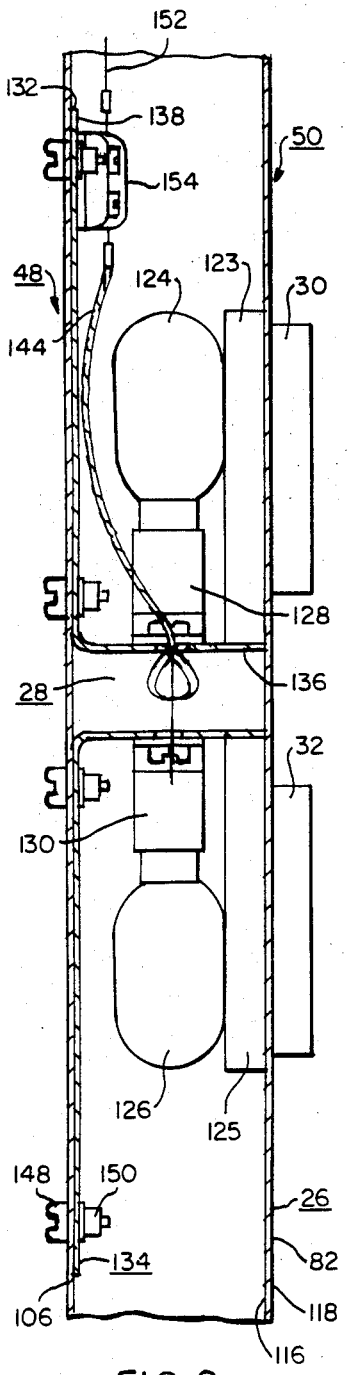
FIG. 2 is a side elevational view, in section, taken between and in the direction of arrows II—II in FIG. 1, illustrating hall lanterns mounted in a door strike post according to the teachings of the invention.
Figure 3:
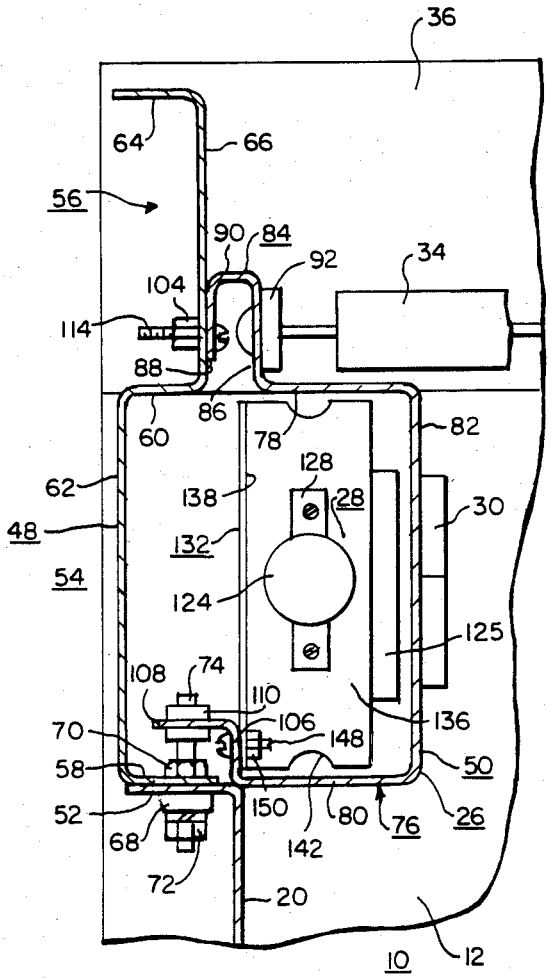
FIG. 3 is a plan view, in section, taken between and in the direction of arrows III—III in FIG. 1, illustrating a strike post assembly constructed according to the teachings of the invention, including inner and outer posts, and the coupling arrangement therefore.
Figure 4:
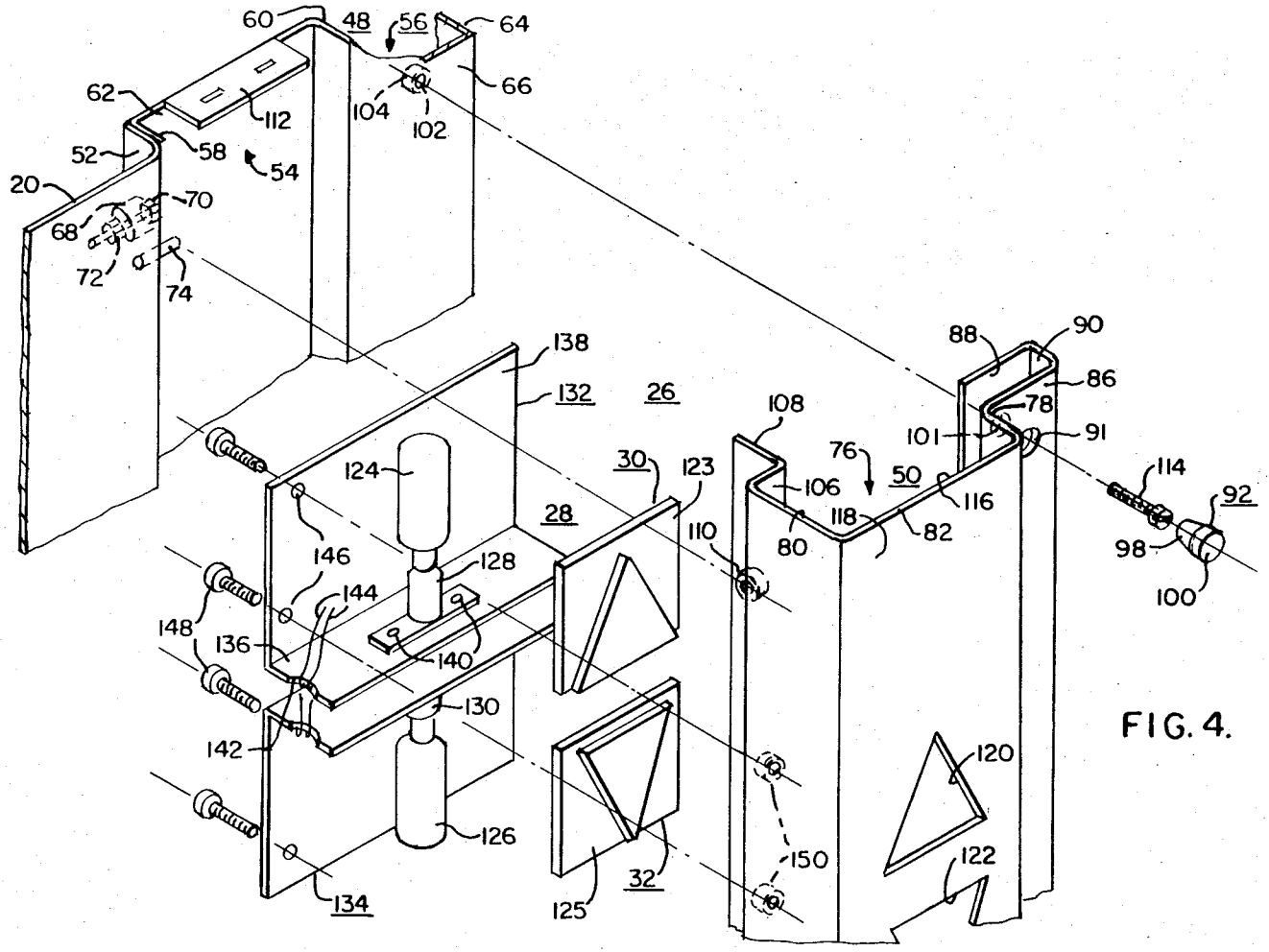
FIG. 4 is a fragmentary, exploded perspective view illustrating the hall lanterns and coupling arrangement for the inner and outer posts of the door strike post.

The door strike post 26 and associated hall lanterns 28 are constructed according to the teachings of the invention, with FIGS. 2 and 3 being cross sectional elevational and plan views of the the strike post 26, taken between and in the directions of arrows II—II and III—III, respectively. FIG. 4 will also be referred to while describing FIGS. 2 and 3, with FIG. 4 being an exploded perspective view of the strike post 26 and hall lanterns 28.

More specifically, the door strike post 26 includes an inner or stationary post 48, and an outer post 50 which is removably fixed to the inner post 48. The inner post 48 is fixed to the first upstanding sidewall portion 20. For example, sidewall portion 20 may have a flange 52 at its lateral edge adjoining strike post 26, which is arranged to be joined to the inner post 48.

Inner post 48 is preferably formed to define first and second in-line but oppositely facing channels 54 and 56, respectively, with the first channel 54 having first and second spaced leg portions 58 and 60, respectively, and a connecting bight portion 62. The second leg portion 60 is common to both channels 54 and 56, and the second channel 56 further includes a leg portion 64 and a bight portion 66. Instead of being constructed in one piece, the inner post 48 may also be constructed from two channel members with their adjoining legs being bolted together to form the common leg portion 60. The first leg portion 58 of the first channel 54 is arranged to be connected to flange 52 of wall panel 20 by any suitable fastener means. For example, a plurality of vertically spaced spacer members 68 may be fixed to leg portion 58 by a bolt 70 and nut 72, with the spacer members being advanced into tear-drop shaped openings (not shown) in the flange 52, and then forced downwardly into the narrow part of the tear-drop shaped openings, such as disclosed in U.S. Pat. No. 4,266,386, which is assigned to the same assignee as the present application.

The inner post 48 includes a plurality of studs 74, such as three, which have one end fixed to the first leg portion 58 of the first channel 54 such that the other end extends towards the second leg portion 60. Studs 74 need not be threaded. Studs 74 may be separate studs, as illustrated, or they may be combined with the fastener function, ie., bolt 70 may be a threaded stud instead of a bolt with a head, with the function of the bolt head being performed by a nut which is advanced on the stud to expose the desired stud length. The plan view of FIG. 3 covers both embodiments, while the perspective view of FIG. 4 illustrates stud 74 as a separate, dedicated item.

The outer post 50 is formed to define a first or main channel 76 having first and second spaced leg portions 78 and 80, respectively, and a connecting bight 82. The first leg portion 78 is additionally formed to define a second or auxiliary channel 84 having first and second leg portions 86 and 88, respectively, and a bight 90. The first leg portion 86 of the auxiliary channel 84 extends perpendicularly outward from the first leg portion 78 of the main channel 76, and is thus parallel with bight 82 which forms the main jamb of the strike post 26. Bight 90 is parallel with the legs 78 and 80 of the main channel 76 and the second leg 88 is in spaced parallel relation with the first leg 86.

The first leg 86 of the auxiliary channel 84 includes a plurality of vertically spaced openings 91 (FIG. 4), such as three, for receiving resilient door stops or bumpers 92, 94 and 96. The stops, such as stop 92 shown in FIG. 4, include a small end 98, which can be forced through opening 91, and a larger end 100 which faces the leading edge of the door 34 and contacts the door when it arrives at its fully closed position. Thus, the stops are held in frictional engagement with the first leg 86 of the auxiliary channel 84.

The second leg 88 of the auxiliary channel 84 includes an opening aligned with each of the door stop receiving openings 91, such as opening 101 shown in FIG. 4. A like number of openings are provided in the bight 66 of the second channel 56 of the inner post 48, such as opening 102 shown in FIG. 4. A nutsert 104 is fixed to bight 66 in alignment with each opening 102, on the side of bight 66 between the spaced leg portions 60 and 64.

The second leg 80 of the main channel 76 of the outer post 50 is formed into an L-shaped configuration having a first leg portion 106 which extends perpendicularly outward from leg 80 towards leg 78, and a second leg portion 108 which extends away from bight 82, parallel with the second leg portion 80. The second leg portion 108 includes a plurality of vertically spaced openings having a resilient bushing or grommet 110 disposed therein. Bushings 110 have openings sized to slidably receive a stud 74.

In the assembly of strike post 26, the inner post 48 is fixed to the upstanding wall panel 20 of cab 10, as hereinbefore described. The inner post 48 additionally has tabs at the top and bottom, such as the top tab 112 shown in FIG. 4, for securing the inner post 48 to the platform 12 and transom 38. If an infra-red door safety beam, or the like, is used, it would be installed between channel legs 60 and 64 of the second channel 56 of the inner post 48. The outer post 50 is placed in an upright position adjacent to the inner post 48, with the major channel openings 54 and 76 of the inner and outer posts 48 and 50, respectively, facing one another, but slightly offset such that leg portion 108 which carries the resilient bushings 110 can be advanced into channel 54 until the openings in the bushings 110 are aligned with studs 74. When the bushing-stud alignement is achieved, the outer post 50 is moved laterally to cause the studs 74 to enter the openings in the resilient bushing 110. When leg 80 of the outer post 50 contacts flange 52 of cab panel 20, openings 91 and 101 of the outer post 50 will be in alignment with the openings 102 in bight 66. Screws 114 are advanced through the relatively large opening 91 to gain access to openings 101 and 102, and to the nutsert 104. Screws 114 simultaneously fix both lateral edges of the outer post 50 to the inner post 48, as studs 74 cannot move out of the resilient bushings 110 once screws 114 firmly fix leg 88 of the outer post 50 to bight 66 of the inner post 48. While one lateral edge of the outer post 50 is not solidly fixed to the inner post 48, but is resiliently fixed thereto, in addition to preventing vibrations and rattles from occurring, the resilient mounting wherein the outer post 50 floats in a shock mounting arrangement also provides the outer post 50 with a slight "give". Thus, the outer post 50 is protected from blows which might otherwise cause scratches and dents, during usage of the elevator cab 10.

After the screws 114 are all secured, the door stops 92 are frictionally engaged in openings 91 by forcing the small end 98 through opening 91 with a twisting motion. This conceals screws 114, but makes it a simple task for authorized personnel to gain access to screws 114 when necessary.

The main advantages of the hereinbefore disclosed construction of the the strike post 26 arise when hall lanterns 28 are mounted in the strike post 26. Face plates with their visible fasteners are eliminated, as the outer post 50 functions as an easily removable cover for the hall lanterns with no visible fastener hardware. Futher, the hereinbefore disclosed construction wherein two metallic channels 54 and 76 are coupled together with their channel openings facing one another creates a vertically elongated space surrounded by metal which functions as an electrical junction box, eliminating the need for separate junction boxes for the hall lantern function.

More specifically, the major planar portion of the outer post 50, defined by bight 82, has inner and outer sides 116 and 118, respectively, and openings 120 and 122 are provided in bight 82 for receiving the up and down direction hall lantern lenses 30 and 32, respectively. Hall lantern lenses 30 and 32 are inserted into openings 120 and 122 from the inner side 116, and they have flanges 123 and 125 which prevent them from being removed from the outer side 118 of bight 82. Lenses 30 and 32 may be held securely in openings 120 and 122 by any suitable means, such as double backed tape, contact adhesive, or weld studs and clips.

Up and down hall lamps 124 and 126 and associated mounting sockets 128 and 130, respectively, are attached to L-shaped metallic brackets 132 and 134, respectively. For example, bracket 132 has first and second leg portions 136 and 138, respectively, socket 128 is attached to leg 136 via screws 140, and depressions 142 are formed in each lateral edge of leg 136 so electrical wires 144 for lamps 124 and 126 can proceed past leg 136 to the undersides of sockets 128 and 130. Fastener openings 146 are provided in leg 138.

Brackets 132 and 134, are disposed in channel 76 of the outer post 50, between its spaced legs 78 and 80, and they are fixed in position adjacent to lenses 30 and 32 via screws 148 which are disposed through openings 146 into openings backed by nutserts 150 in leg portion 106 of the outer post 50.

As shown in FIG. 2, wires 152 from a hall lantern control function may be attached to a terminal strip 154 which is fixed to leg portion 106, and the wires 144 which are connected to the lamp sockets 128 and 130 are connected to the terminal strip 154.

In summary, there has been disclosed a new and improved elevator cab in which the door strike post is constructed as a large electrical junction box, with the entire jamb of the strike post functioning as an easily removed cover having concealed fastener hardware. Thus, authorized personnel can quickly and easily gain access to hall lantern lamps mounted in the strike post, while discouraging vandalism by eliminating face plates and visible fastener hardware. The strong box-like construction and resilient mounting enables the removable outer strike post to be contructed of 0.048 inch thick steel instead of 0.075 inch thick steel. At least the concealed channel 54 of the inner strike post 48 is constructed of 0.075 inch thick steel. If the visible channel 56 of the inner post 48 is formed from a separate channel, it may be constructed of 0.048 inch thick steel.

We claim as our invention:

1. An elevator cab, comprising:

a platform, upstanding wall panels on said platform which define an enclosure having an opening therein, a door operable to open and close said opening, a strike post assembly for said door, hall lanterns in said strike post assembly, said strike post assembly including an inner stationary post fixed to an upstanding wall panel of the cab, and an outer post removably coupled to said stationary post, said outer post including a mjor planar portion having an inner side which is spaced from the inner stationary post and an outer side, hall lantern lenses, openings in the major planar portion of said outer post for receiving said hall lantern lenses from the inner side of the outer post, without fastener hardware apparent on the outer side, door stops, openings in said outer post for frictionally receiving said door stops, and fastener means connecting said outer post to said inner post, with said fastener means being accessible only when the door stops are removed from the outer post, whereby the entire outer post fuctions as a removable cover for the hall lanterns, devoid of externally visible fasteners for the outer post and hall lantern lenses.

2. The elevator cab of claim 1 wherein the inner and outer posts are elongated metallic members having a generally channel shaped cross sectional configuration, including bight and spaced leg portions which define channel openings, and wherein the channel openings of the inner and outer posts are disposed to face one another, forming a rigid boxed beam which also functions as a metallic, enclosed wiring trough and electrical box for the hall lanterns.

3. The elevator cab of claim 1 wherein the outer post defines first and second channels, each including a bight and first and second spaced leg portions, with the first leg portion of the second channel extending perpendicularly outward from the first leg portion of said first channel and defining openings for receiving the door stops, and with the second leg portion of the second channel having openings aligned with the openings of the first leg portion for receiving the fastener means which connects the outer post to the inner post.

4. The elevator cab of claim 3 wherein the inner post includes a plurality of vertically spaced studs and the second leg portion of the first channel of the outer post includes a plurality of vertically spaced stud receiving openings for slidably receiving said vertically spaced studs, to secure the second leg of the first channel to the inner post when the fastener means connects the second leg of the second channel to the inner post.

5. The elevator cab of claim 4 including resilient bushing disposed between the studs of the inner post and the stud receiving openings of the outer post.

6. The elevator cab of claim 4 wherein the plurality of vertically spaced studs also cooperate in the fixing of the inner post to an upstanding wall panel of the cab.

* * * * *